United States Patent [19]

Stark et al.

[11] 4,130,068

[45] Dec. 19, 1978

[54] CENTER FILLER FOR RAILWAY CARS

[75] Inventors: Marvin Stark, Houston, Tex.; Steve L. Suvada, Michigan City, Ind.

[73] Assignee: Pullman Incorporated, Chicago, Ill.

[21] Appl. No.: 877,145

[22] Filed: Feb. 13, 1978

[51] Int. Cl.[2] ..... B61F 1/08; B61F 5/16

[52] U.S. Cl. ..... 105/420; 213/57

[58] Field of Search ..... 213/57, 51, 54, 56; 105/420, 414, 415, 416, 199 C

[56] References Cited

U.S. PATENT DOCUMENTS

| | | | |
|---|---|---|---|
| 3,677,198 | 7/1972 | Yang et al. | 105/420 |
| 3,954,066 | 5/1976 | Heap | 105/420 |
| 3,985,235 | 10/1976 | Buzza | 213/57 |

*Primary Examiner*—Trygve M. Blix
*Assistant Examiner*—Charles E. Frankfort
*Attorney, Agent, or Firm*—Thomas G. Anderson

[57] ABSTRACT

A center filler arrangement for railway vehicles provides a large center filler bottom lug welded in position and having mounting recesses for front and rear center filler plates to interconnect the side webs of a center sill to provide a rigid, dimensionally stable, flat surface for attachment of a center plate.

4 Claims, 6 Drawing Figures

CENTER FILLER FOR RAILWAY CARS

BACKGROUND OF THE INVENTION (1) Field of the Invention

This invention pertains to that portion of a railway vehicle underframe where the body bolsters are attached to the center sill and more particularly to the structure of the underframe to which the center plate is attached.

(2) Description of the Prior Art

The prior art center filler arrangements have provided a number of plates, weldments, rigidifying ribs and the like to adequately maintain the dimensional stability across the bottom of the center sill in order that the center plate may be attached to what is considered a completely flat surface. While the prior art has recognized the problem of uneven mating between the center plate and the bottom of the center filler as causing stress concentrations, cracking and premature failure, no satisfactory attachment arrangement has been provided.

SUMMARY OF THE INVENTION

This invention pertains to an improved center filler arrangement whereby a large center filler lug interconnects the side webs of a center sill in the bolster area. The center filler lug includes an enlarged piece of metal having recesses providing mounting surfaces for attachment of upwardly extending center filler plates horizontally extending bottom cover plates. By completely rigidifying the bottom portion of the center sill in the center filler area, dimensional stability is maintained between the side flanges of the center filler and an essentially flat surface can be provided for attachment of the center plate.

In operation and use, the center filler, comprising the lug and attached plates, may be constructed as a subassembly away from the railway vehicle and later positioned within the opening of the center sill in the bolster area. Afterwards, the bottom edges of the lug and the bottom plates are completely welded to the center sill. Thus the bottom of the lug and the side flanges of the center sill may be machined, if necessary, into a completely flat surface before the center plate is attached.

It is an object of this disclosure to provide improved center filler arrangement comprising a so-called center filler lug which is an enlarged piece of metal extending across the bottom of the center sill to produce a rigid box beam in the center filler area to resist tension, bending and other forces.

It is yet another object of the invention to provide a center filler having a bottom portion comprising a center filler lug positioned within the center sill opening and welded to each side of the center sill to provide a flat surface for attachment of a center plate.

These and other objects of the invention will become apparent to those having ordinary skill in the art with reference to the following description, drawings and appended claims.

DETAILED DESCRIPTION

Figure 1:
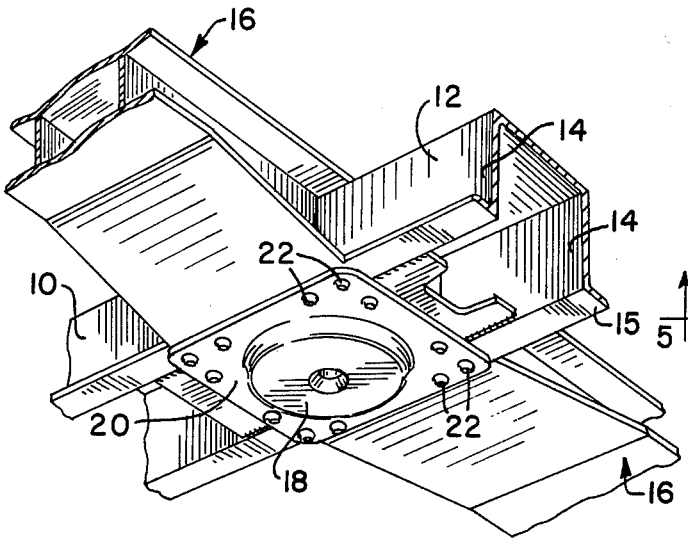
FIG. 1 is a perspective illustration of a portion of the underframe of a railway vehicle showing the structure at the junction of the bolster and center sill.

Referring now to the drawings and in particular to FIG. 1, there is shown a railway center sill 10 which is a primary longitudinally extending load bearing member that extends from one end of a railway vehicle to another. The end portions of the center sill are frequently referred to as a draft sill and are designated in the drawings as item 12. Center sill 10 includes spaced, side webs 14 having bottom flanges 15 extending outwardly therefrom. As shown in FIG. 1, a so-called body bolster beam 16 extends from each side of the center sill and provides vertical support to the car body (not shown).

Attached to the underside of the car underframing at the junction of the bolsters 16 and the center sill 10 is a conventional center plate 18. Extending outwardly from the center plate portion 18 is a center plate skirt 20 which contains openings into which rivets or high strength bolts are extended to securely attach the center plate to the car underframe.

Figure 2:
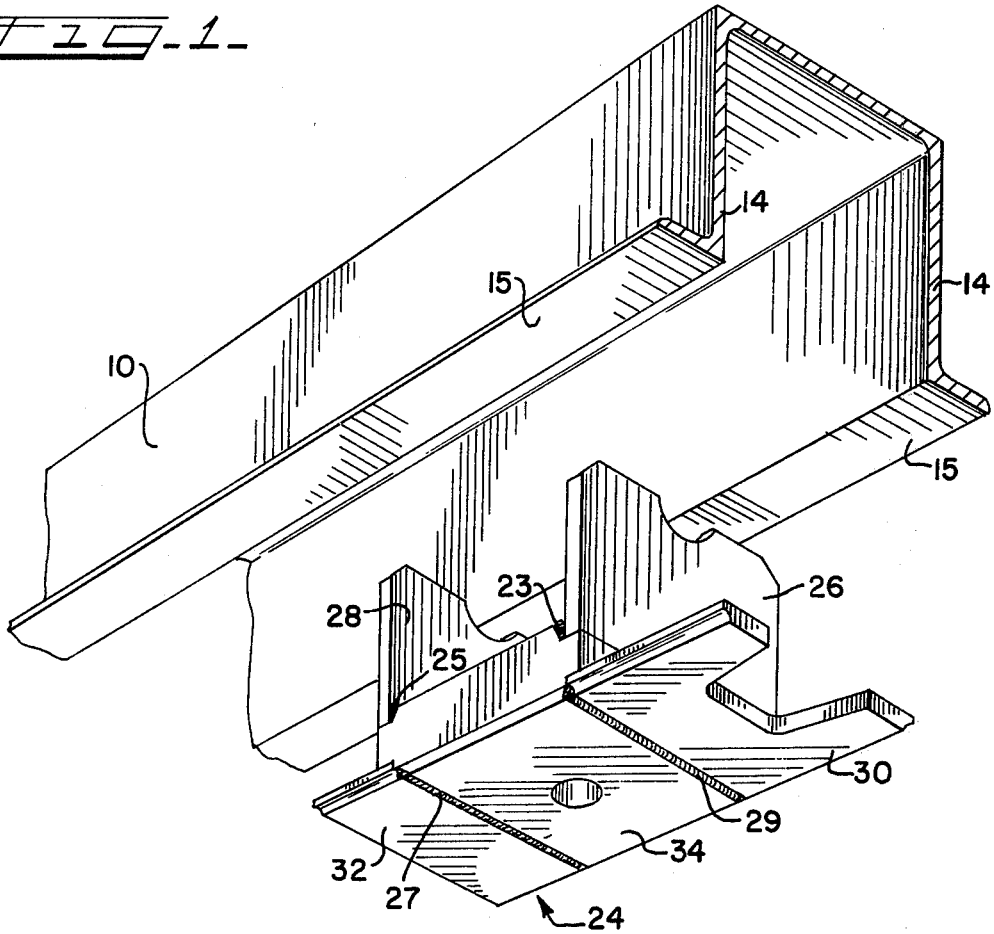
FIG. 2 is an exploded illustration of the center filler and a portion of the center sill into which it is positioned.
Figure 4:
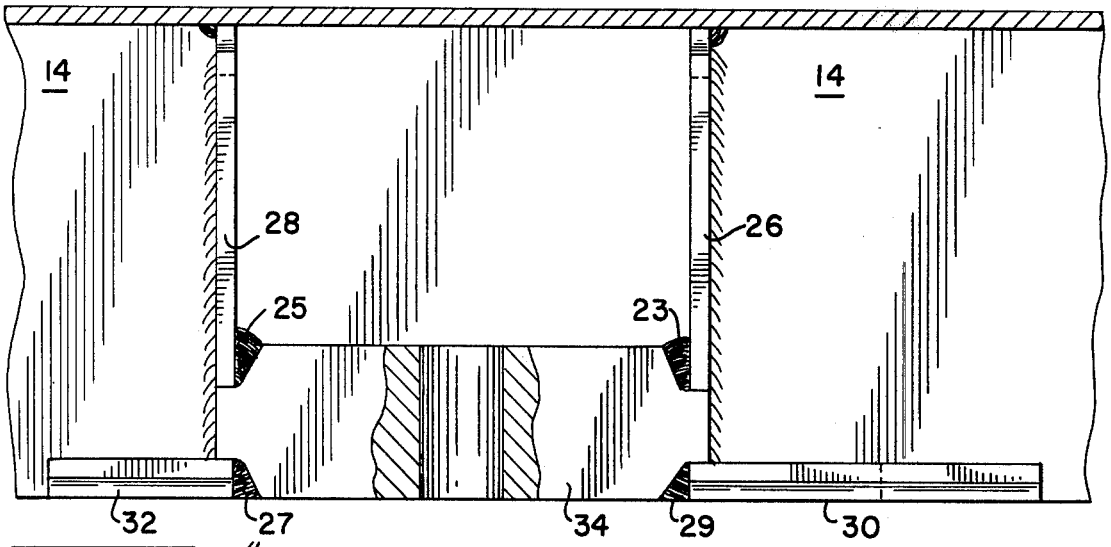
FIG. 4 is a sectional view taken generally along lines 4—4 of FIG. 3.

As shown in FIG. 2, there is a reinforcing structure above the center plate 18 that reinforces center sill 10 at the point where bolsters 16 are attached. This reinforcing structure is referred to as a center filler and designated by the number 24. Center filler 24 includes a front cover plate or rib 26 and a rear cover plate or rib 28. Extending horizontally and forming a portion of the center filler 24 are a front bottom cover plate 30 and a rear bottom cover plate 32. The bottom cover plate members 30, 32 of the center filler 24 are attached by welds at 27, 29 to a large center filler lug 34. Front and rear vertical ribs 26, 28 are attached to lug 34 by welds 23, 25 respectively. Ribs 26, 28 are also welded to the center sill webs 14. At each point of attachment of the plates lug 34 has been so contoured to not only provide a mounting surface or ridge for the attached plates but also to provide a recess for weld metal to securely form a connection between the center filler plates and the lug 34.

Figure 3:
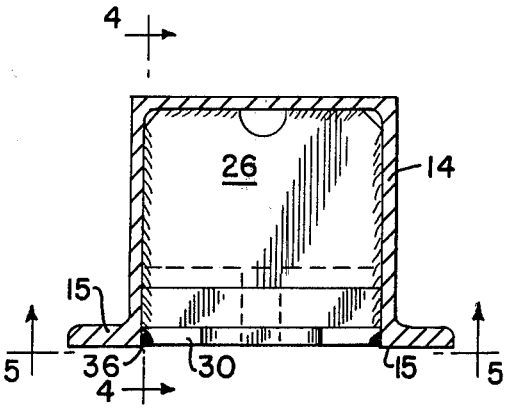
FIG. 3 is a transverse sectional view of the center filler disclosed herein.
Figure 5:
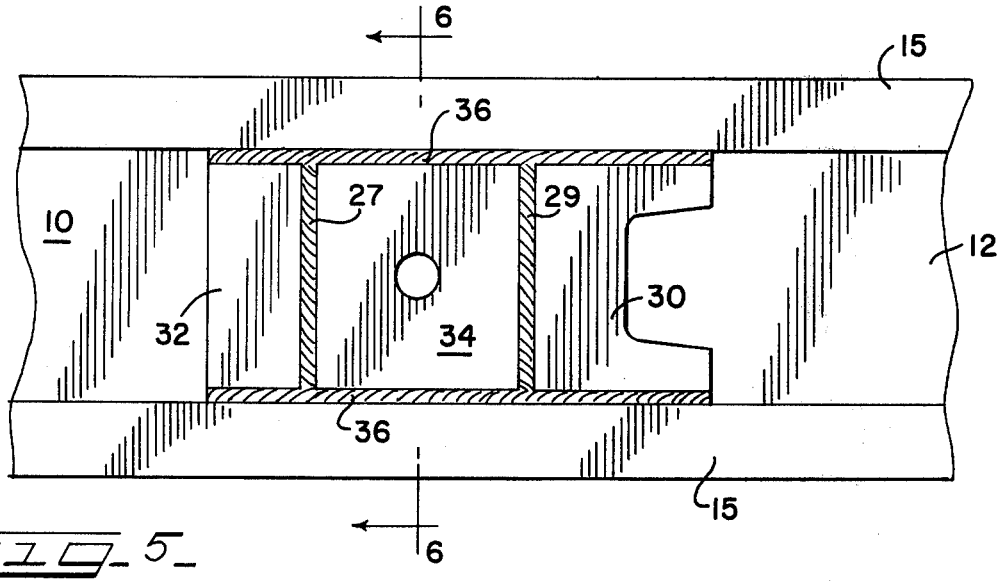
FIG. 5 is a bottom view taken generally along lines 5—5 of FIG. 3.
Figure 6:
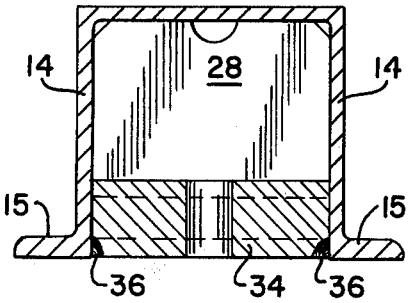
FIG. 6 is a sectional view taken generally along lines 6—6 of FIG. 5.

As mentioned earlier, if the center filler subassembly 24 is constructed away from the center sill 10 it is then inserted as a unit into the center sill opening and welded into position as shown by the welds indicated in FIGS. 3, 5 and 6. When so positioned the center filler lug 34 provides a rigid interconnection between the center sill side webs 14 and also performs a rigid continuation of the bottom flanges 15.

After the center filler lug 34 is positioned, the surface extending from the edges of the bottom flanges 15 and across the bottom surface of the lugs 34 may be machined into a completely flat surface to which the center plate mounting skirt 20 may be attached.

By utilizing a filler lug 34 approximately four inches thick and welding lug 34 securely in position, the interconnected portion of the center sill is rigidified to resist shear, tensile, twisting and fatigue loading. Further, bottom cover plates are approximately one inch thick and further rigidify and provide for even force distribution to reduce stress. The lug 34 is contemplated as being 3–5 times thicker than the bottom cover plate.

The foregoing description and drawings merely explain and illustrate the invention and the invention is not limited thereto, except insofar as the appended claims are so limited, as those who are skilled in the art and have the disclosure before them will be able to make modifications and variations therein without departing from the scope of the invention.

What is claimed is:

1. In a railway vehicle having an underframe comprising body bolsters extending transversely from a longitudinally extending center sill, said center sill having spaced side webs and bottom flanges extending outwardly from each side web, the improvement comprising:

a center filler;

said center filler including lug means;

said lug means including means for abutting and interconnecting the spaced side webs of the center sill;

said lug means having a bottom surface in a plane with the bottom of each bottom flange of the center sill;

said lug means having a top surface spaced a first distance from the bottom surface;

weld means attaching the lug means to the center sill;

bottom plate means with means abutting said lug means;

second weld means attaching the bottom plate means with said lug means and with said center sill webs;

said bottom plate means having a lower surface in a plane with the bottom surface of said lug means and having a top surface spaced from the bottom surface a second distance;

said first distance of the lug means being in the range of three to five times the second distance of the bottom plate means.

2. The railway vehicle underframe of claim 1 wherein said center filler includes:

front and rear vertically extending cover plates;

mounting ridge means on said lug means;

said vertically extending cover plates having bottom means attached to said lug means and side means attached to the side webs of the center sill.

3. The railway vehicle underframe of claim 1 wherein said bottom plate means includes:

a front, bottom cover plate;

said lug means including a recess with means overlapping a portion of the front, bottom cover plate; and said recess having means to receive weld filler metal.

4. The railway vehicle underframe of claim 1 wherein said bottom plate means include:

a rear, bottom cover plate;

said lug means including a rear recess with means overlapping a portion of the rear, bottom cover plate;

said rear recess having means to receive weld filler metal.

* * * * *